US005438737A

United States Patent [19]

Anscher et al.

[11] Patent Number: 5,438,737

[45] Date of Patent: Aug. 8, 1995

[54] SNAP CLOSURE TYPE BUCKLE WITH QUICK RELEASE

[75] Inventors: Joseph Anscher, Muttontown, N.Y.; John Bull, West Chiltington, Great Britain

[73] Assignee: National Molding Corporation, Farmingdale, N.Y.

[21] Appl. No.: 227,657

[22] Filed: Apr. 14, 1994

[51] Int. Cl.[6] ..... A44B 11/00

[52] U.S. Cl. ..... 24/630; 24/615; 24/625

[58] Field of Search ..... 24/630, 615, 616, 607, 24/625, 634, 200; 297/467, 464

[56] References Cited

U.S. PATENT DOCUMENTS

| | | | |
|---|---|---|---|
| 3,694,029 | 9/1972 | Noble et al. | 297/467 |
| 4,150,464 | 4/1979 | Tracy | 24/615 |
| 4,402,548 | 9/1983 | Mason . | |
| 4,569,106 | 2/1986 | Lovato . | |
| 4,587,695 | 5/1986 | Jensen | 24/634 |
| 4,793,032 | 12/1988 | Crowle . | |
| 4,831,694 | 5/1989 | Kong | 24/615 |
| 4,962,965 | 10/1990 | Glover | 297/467 |
| 5,131,122 | 7/1992 | Lavato | 24/616 |
| 5,222,279 | 6/1993 | Frano et al. | 24/625 |
| 5,272,795 | 12/1993 | Rothstein | 24/615 |

*Primary Examiner*—Victor N. Sakran
*Attorney, Agent, or Firm*—Collard & Roe

[57] ABSTRACT

A buckle assembly configured for one-handed release by an operator thereof, including a pair of clasps, each having a release tab. Each of the clasps are adapted for release by pressure from a single finger of the operator on the release tab. A main buckle is designed to independently and releasably engage the clasps. The main buckle is configured so that both clasps are releasable from the main buckle with two fingers of one hand.

17 Claims, 4 Drawing Sheets

SNAP CLOSURE TYPE BUCKLE WITH QUICK RELEASE

BACKGROUND OF THE INVENTION

1. Field of the Invention

The present invention relates to a snap closure type buckle with quick release clasps. More particularly, the invention relates to a buckle, for use with an infant carrier or high chair, for example, where both clasps can be released with one hand.

2. The Prior Art

Snap closure type buckles are known for removably connecting the ends of straps together for a variety of applications. These snap closure type buckles are frequently used for children's high chairs and car seats to strap the child's legs and/or shoulders into the seat. The shortcomings of these known high chair and car seat strap arrangements are evidenced by a large number of commercial devices in use today as well as a large number of patents issuing on devices attempting to overcome the deficiencies of the prior art. For example, U.S. Pat. No. 4,569,106 to Lovato discloses a buckle with two identical engageable parts. U.S. Pat. No. 4,793,032 to Crowle discloses a side release buckle and U.S. Pat. No. 4,402,548 to Mason discloses a safety seat for vehicles. However, none of these patents discloses a buckle arrangement where a main buckle is coupled to a crotch strap and each of the leg or shoulder straps are independently engageable with the main buckle. In addition, none of the patents show a buckle where the two leg/-shoulder straps can be independently released from the buckle by pressure from a single finger, or simultaneously released from the buckle with one hand alone.

Therefore, it would be advantageous to provide an inexpensive molded buckle where two clasps can be independently engaged with the main buckle and only one hand is needed to release one or both clasps.

SUMMARY OF THE INVENTION

It is therefor an object of the present invention to overcome the drawbacks of the prior art and to provide a snap closure type buckle with quick release that can be simply and inexpensively manufactured by injection molding.

It is still a further object of the present invention to provide a buckle where each clasp can be released with a single finger.

It is a further object of the present invention to provide a buckle in which both clasps can be simultaneously released with one hand.

These and other related objects are achieved according to the invention by a buckle assembly configured for one-handed release by an operator thereof. The buckle assembly includes a pair of clasps, each having a flexible release tab and a main buckle. The main buckle includes a hollow body with two sidewalls and an opening corresponding to each sidewall for removably receiving the clasps. A locking slot extends through each sidewall for providing access to the release tabs. Each flexible release tab snaps into the respective locking slot to engage the sidewall upon full insertion of the clasp. The locking slots are positioned on the main buckle, so that the flexible release tabs are adapted for pressure contact by two fingers of one hand, to release the pair of clasps.

Each clasp consists of a base member, first and second arm members extending from the base member in a lateral spaced apart relation to each other with the release tab mounted on the first arm member. The engaging relationship between the clasps and the main buckle is such that the release tabs seat in respective locking slots of the hollow body by snap action whenever the clasps are fully inserted into the openings. This provides a latching relationship therebetween and each of the clasps is unlatched by depressing the respective release tab inwardly of the corresponding locking slot a sufficient distance to pass beyond the sidewall.

Each of the release tabs includes an exterior surface that extends into the locking slot when the clasp is fully inserted in the main buckle. The exterior surface is configured and dimensioned so that at least a portion of the exterior surface faces away from the corresponding opening. Pressure on the facing away portion while depressing the release tab propels or ejects the clasp outwardly of the opening. The exterior surface is rounded so that a finger or digit slides along the rounded surface as the release tab is depressed, moving the clasp away from the locking slot.

Each clasp further includes an axially-extending guide element extending from the base member and disposed between the first and second arms. The main buckle further includes guide means extending axially within each of the openings and complimentary to the guide element. The guide means is spaced inwardly from the locking slot for cooperative sliding engagement with the guide element during telescopic association therebetween without interference with the first and second arm members and the release tab of the clasps. The guide element and the guide means are disposed off center of the base member and the opening, respectively, so that the base members are inserted into the opening in a particular orientation only.

In an alternate embodiment of the buckle arrangement, the two openings are in communication with each other and the clasps are adapted for contacting each other upon joint release of the clasps. The second arm member defines an axially extending resilient guide element extending from the base member. The two guide elements are disposed parallel to each other when both are fully inserted in the main buckle.

The main buckle further includes guide means extending axially within each of the openings and complimentary to the guide element and spaced inwardly from the locking slot. The guide means engages the guide element in a cooperative sliding manner during telescopic association therebetween without interference with the first arm member and the release tab of the clasps. The guide element and the guide means are disposed off center of the base member and the opening, respectively, so that the base member is inserted into the opening in a particular orientation only.

The guide elements have a T-shaped cross section including a base portion. The T-shapes are oriented in opposite directions from each other with the base portions facing each other. Simultaneous depression of the release tabs biases the base portions of the resilient guide element into contact with each other so that the clasps are ejected or propelled outwardly of the communicating openings together with increased spring released action.

BRIEF DESCRIPTION OF THE DRAWINGS

Other objects and features of the present invention will become apparent from the following detailed description considered in connection with the accompanying drawings which discloses two embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
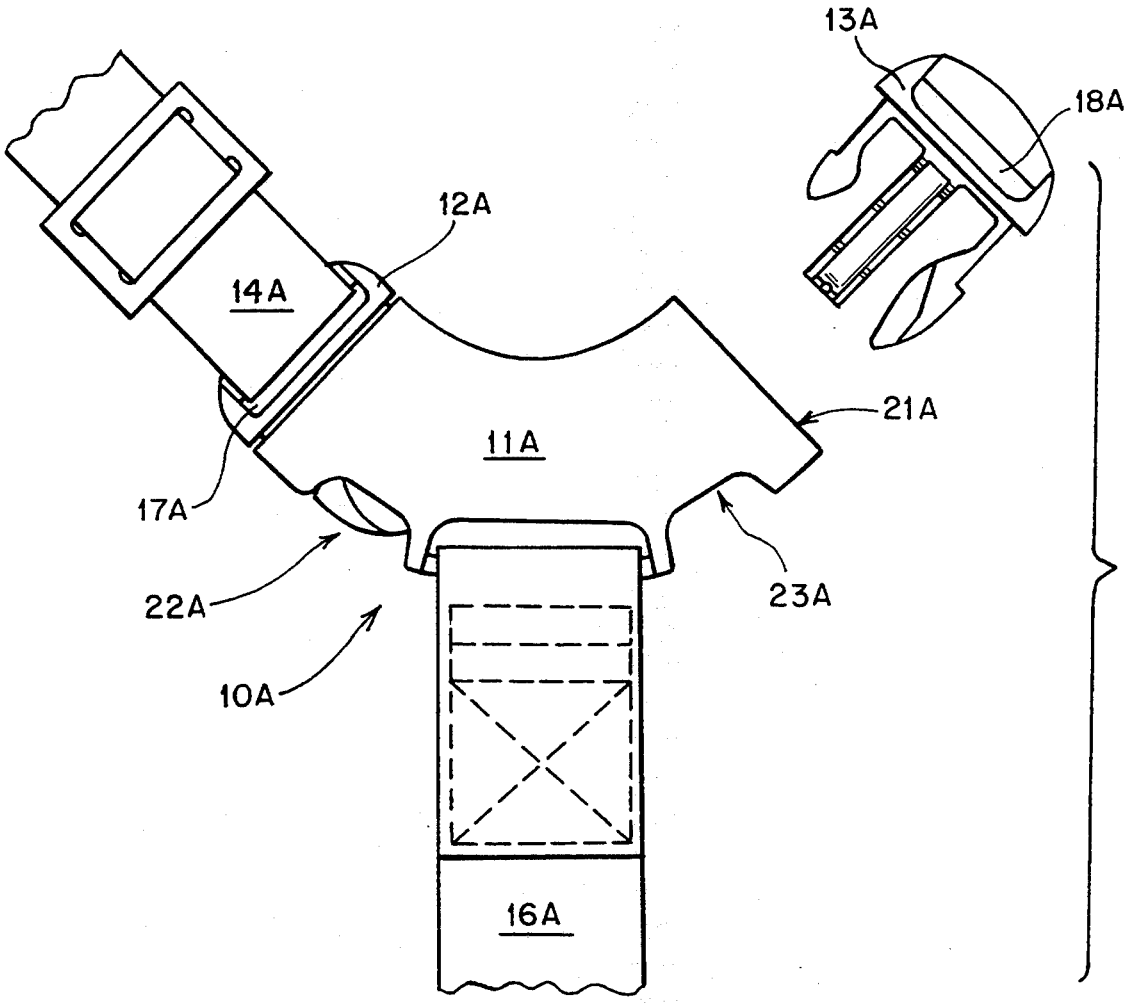
FIG. 1 is a front side elevational view of an embodiment of the buckle arrangement according to the invention.

Referring now to the drawings and, in particular, FIG. 1, there is shown a buckle assembly 10A including a separable cooperating main buckle 11A and clasps 12A and 13A. The buckle and clasps are made of a tough resilient plastic material, for example, acetal, nylon, or polypropylene.

Clasps 12A and 13A have strap slots 17A and 18A at one end thereof to receive a strap or belt. Clasp 12A is shown connected to a length adjustable strap 14A. It should be understood that depending on the application, either one or both straps may be provided with adjustable length or fixed length strapping. It should also be understood that the back end of each clasp may have alternate web attachment designs where two or more cross bars are arranged in a ladder formation and offer web adjustment ability. Geometry of such bars can be seen in prior art patent D340,886. Main buckle 11A is also provided with an opening for receiving a third strap or belt. Main strap 16A is shown as a fixed length strap which passes through the opening in main buckle 11A and is then sewn back onto itself.

In the configuration shown, main strap 16A extends generally vertically from the bottom of main buckle 11A with clasps 12A and 13A and their respective straps extending outwardly from main buckle 11 in the 10:00 o'clock and 2:00 o'clock positions, respectively, with the main strap 16A being at the 6:00 o'clock position. This orientation of the straps may be used for a child's high chair or a child's car seat, where strap 16A is a crotch strap and clasps 12A and 13A connect to leg straps or shoulder straps. However, buckle assembly 10A may be utilized in almost any application where it is desirous to independently connect and disconnect three straps together at a common point. The angles at which the straps extend out from main buckle 11A can be modified to suit many different applications. The bottom side of main buckle 11 is curved with locking slots 22A and 23A formed within the bottom side. Locking slots 22A and 23A are positioned close enough to each other to be accessible by two fingers, i.e. index and fourth finger, of one hand.

Figure 2:
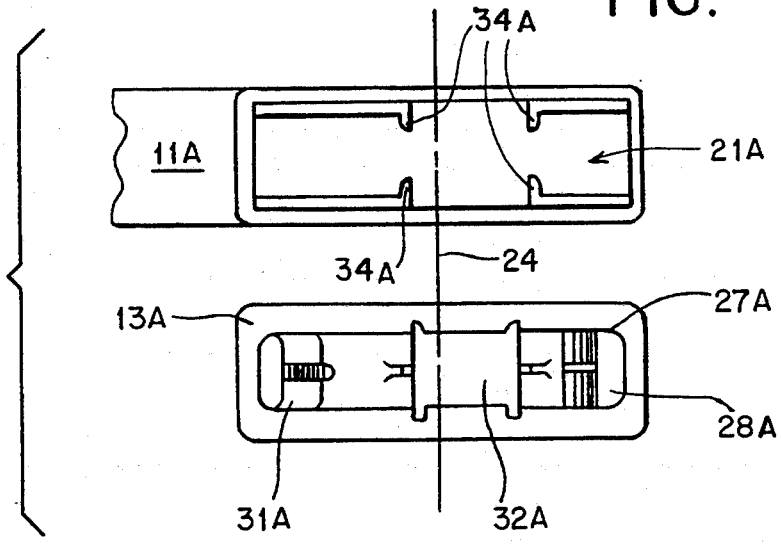
FIG. 2 is a top plan view of an opening of the main buckle and a corresponding clasp.
Figure 3A:
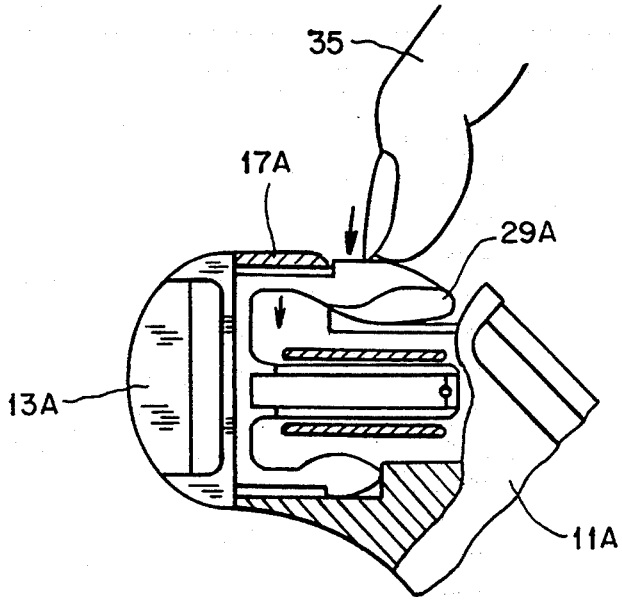
FIGS. 3A and 3B are a front side elevational view in part cross section, showing a clasp being released from the main buckle.
Figure 3B:
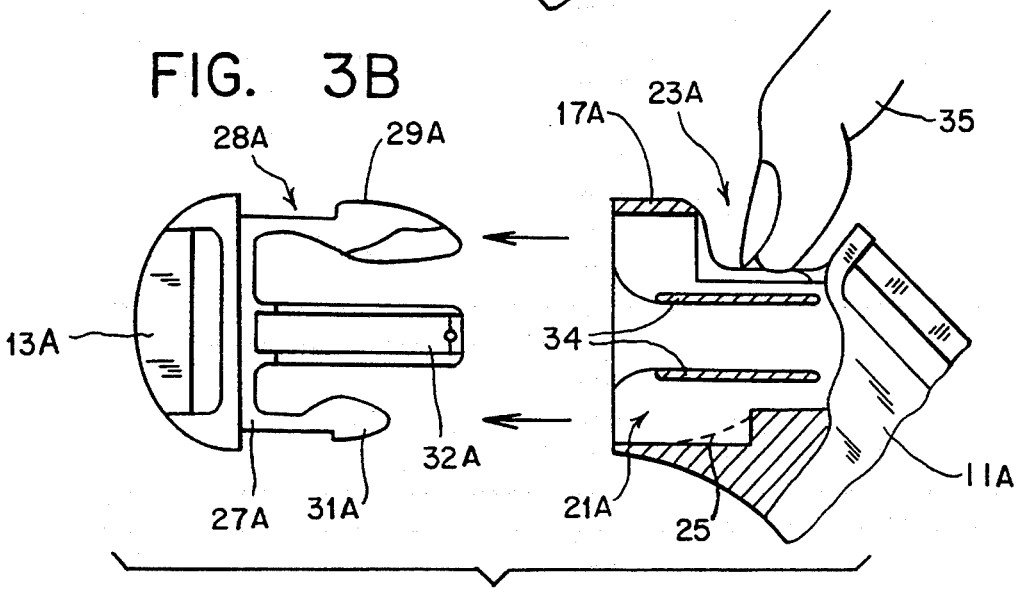

Referring now to FIGS. 2, 3A and 3B, there is shown locking slot 23A and opening 21A which includes guide tracks 34. Clasp 13A includes a base member 27A with first arm 28A and second arm 31A extending axially from base 27A. Arm 28A comprises a resilient relatively narrow body portion and an enlarged release tab 29A extending laterally therefrom. As shown best in FIG. 3A, arm 28A is adapted to flex inwardly toward second arm 31A during coupling and uncoupling. Optionally, a slightly tapered surface 25 is located on the inside wall of main buckle 11A which flexes arm 31A toward arm 28A. The flexing of arm 31A causes a constant counter pressure that provides a more even axial load upon disengagement.

A guide element or guide rail 32A also extends axially from base member 27A, and is disposed between first arm 28A and second arm 31A. Guide rail 32A has an H-shaped cross section, for example. As can be seen in FIG. 2, guide tracks 34A and guide rail 32A are offset to the right of center line 24 to ensure that clasp 13A is always inserted into opening 21A with release tab 29A facing locking slot 23A.

FIG. 3A shows clasp 13A fully inserted into main buckle 11A with release tab 29A being accessible through locking slot 23A. A single finger 35 of the operator presses down on release tab 29A, so that first arm 28A flexes toward second arm 31A to clear sidewall 17A of main buckle 11A. Thereafter, finger 35 slides along the rounded surface of release tab 29A, thus imparting a force directing clasp 13A outwardly of opening 21A, as can be seen in FIG. 3B. The applied pressure to release tab 29A, along with the counter pressure of arm 31A against surface 25, causes clasp 13A to positively propel or eject out of main buckle 11A.

Ideally, main buckle 11A is configured so that two fingers of one hand can each release one of the clasps. As can be seen in FIG. 1, the operator's hand can grasp main buckle 11A with the second and fourth fingers each on one of the release tabs. The operator's third finger overlies strap 16A and the thumb is placed on the top, or 12:00 o'clock position, of main buckle 11A. The second and fourth fingers are urged toward the thumb, resulting in a simultaneous positive ejection of clasps 12A and 13A. The advantages of being able to positively release two clasps with a single hand only will be readily apparent particularly for parents of small children. Thus, while unlocking buckle assembly 10A, one hand is always free to hold the child, the car door, etc.

Referring now to FIGS. 4, 5, 6 and 7, an alternate embodiment of the buckle assembly is shown. Those elements which correspond to the embodiment shown in FIGS. 1, 2, 3A and 3B will carry similar numbers, but will be designated by the letter "B" instead of the letter "A".

Figure 4:
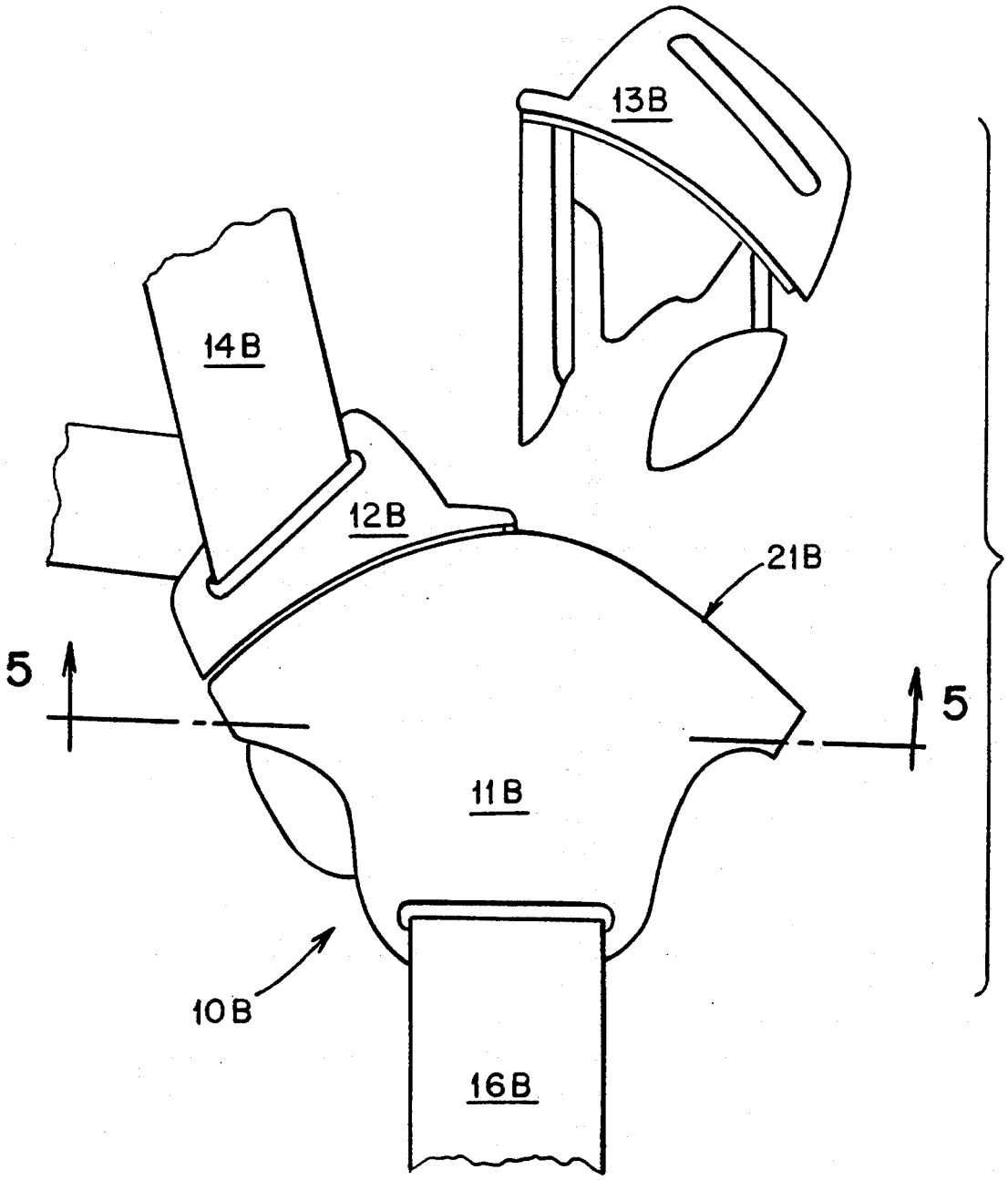
FIG. 4 is a front side elevational view of an alternate embodiment of the buckle assembly.

As can be seen in FIG. 4, clasp 12B is oriented so that instead of having strap 14B terminate at said clasp, it can simply pass through the opening in said clasp. Thus, strap 14B can pass over the child's shoulder through clasp 12B and then exit from the back of said clasp and pass over the child's leg.

Figure 5:
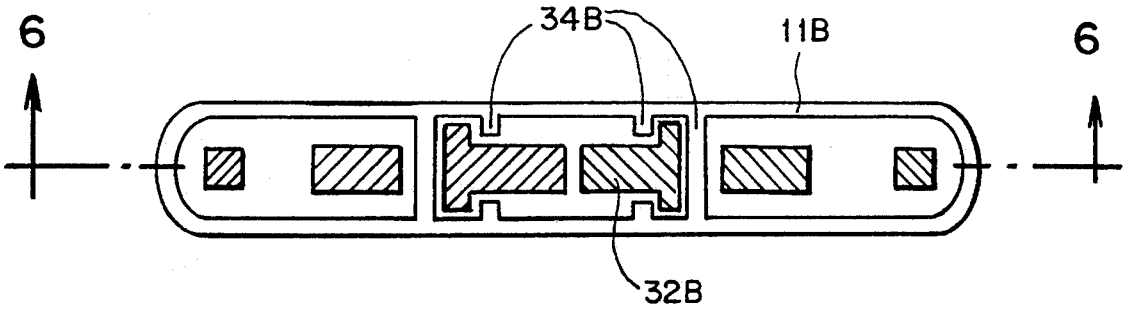
FIG. 5 is a cross-sectional view, taken along the line V—V of FIG. 4, with both clasps fully inserted.
Figure 6:
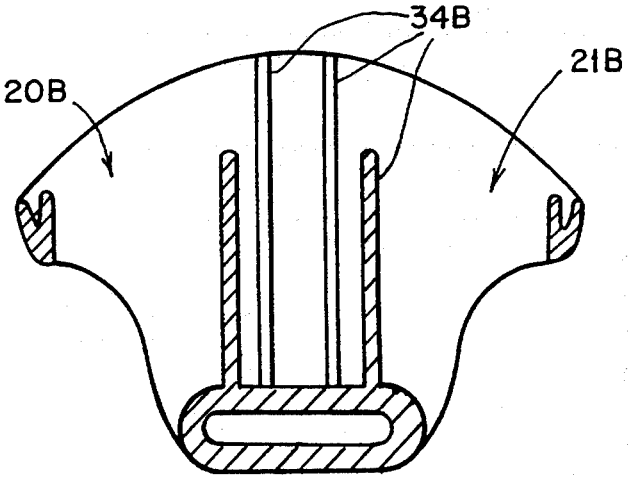
FIG. 6 is a cross-sectional view, taken along the line VI—VI of FIG. 5, with both clasps removed.
Figure 7:
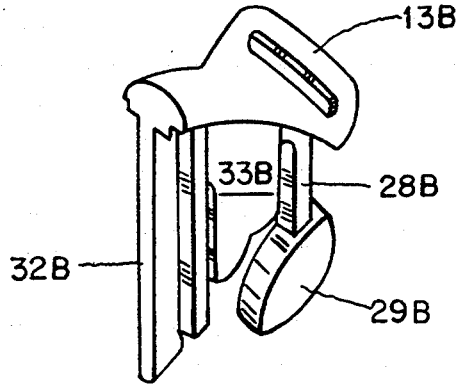
FIG. 7 is a perspective view of the clasp.

Of significant difference with the first embodiment, clasps 12B and 13B are oriented slightly different within main buckle 11B, owing primarily to the fact that openings 20B and 21B communicate with each other across the top portion of main buckle 11B, as can be most clearly seen in FIG. 6. As can be seen in FIGS. 5 and 7, clasp 13B has a first arm 28B equipped with a release tab 29B, just as in the first embodiment. However, of major difference is the fact that guide rails 32B are disposed at the other end of clasp 13B with a second arm 33B located in between first arm 28B and guide rail 32B. Guide rails 32B have a T-shaped cross section with the bases of the two Ts facing each other when both clasps 12B and 13B are fully inserted in main buckle 11B, as can be seen in FIG. 5.

Upon simultaneous release of clasps 12B and 13B, guide rails 32B contact each other along the center plane of buckle assembly 10B. Guide tracks 34B and guide rails 32B are configured and dimensioned so that when guide rails 32B contact each other, they do not touch guide tracks 34B. In addition, the contact of guide rails 32B with each other biases the guide rails toward their corresponding locking tabs. The flexing of guide rails 32B essentially spring loads the clasps, whereby the spring loading in conjunction with the force imparted onto release tab 29B by the operator's fingers, forcefully ejects the clasps from the main buckle. The contact of guide rails 32B with each other essentially minimizes or eliminates the contact and associated friction with guide tracks 34B, or any part of main buckle 11B. Accordingly, the combined reduction or elimination of friction and the spring loading of the guide rails permits the clasps to be forcefully ejected from main buckle 11B with a minimal of effort on the part of the operator.

While several embodiments of the present invention have been shown and described, it is to be understood that many changes and modifications may be made thereunto without departing from the spirit and scope of the invention as defined in the appended claims.

What is claimed is:

1. A buckle assembly configured for one-handed release by an operator thereof, the buckle assembly comprising:

a pair of clasps, each having a flexible release tab; and a main buckle including a hollow body with two sidewalls, an opening for jointly receiving said clasps, and a locking slot extending through each sidewall for providing access to the release tabs;

each flexible release tab snaps into the respective locking slot to engage the sidewall upon full insertion of the clasp, and the locking slots are positioned on the main buckle so that the flexible release tabs are adapted for pressure contact by two fingers of one hand wherein simultaneous depression of said release tabs biases said pair of clasps into contact with each other so that said pair of clasps is propelled outwardly of the opening together with increased spring-release action.

2. The buckle assembly according to claim 1, wherein each clasp comprises a base member and first and second arm members extending from said base member in a lateral spaced apart relation to each other;

said second arm member defines an axially extending resilient guide element extending from said base member; and said two guide elements are disposed in parallel to each other when both clasps are fully inserted in said main buckle.

3. The buckle assembly according to claim 2, wherein said main buckle further includes:

guide means extending axially within each of the openings and complementary to said guide element and spaced inwardly from the locking slot for cooperative sliding engagement with the guide element during telescopic association therebetween without interference with the first arm member and the release tab of the clasps.

4. A buckle assembly configured for single-handed release by an operator thereof, the buckle assembly comprising:

a pair of clasps, each having a flexible release tab; and a main buckle including a hollow body with an inner surface, two sidewalls, an opening corresponding to each sidewall for removably receiving said clasps, and a locking slot extending through each sidewall for accessing said release tab;

wherein each flexible release tab snaps into the respective locking slot to engage the sidewall upon full insertion of the clasp, and wherein the locking slots are positioned on the main buckle so that said release tabs are adapted for pressure contact by two fingers of one hand to press each clasp against a section of said inner surface opposite the respective locking slot, whereby said section exerts counter pressure on said clasps during release of said clasps from said main buckle.

5. The buckle assembly according to claim 4, wherein each of said clasps comprises:

(a) a base member; and (b) at least one arm member extending from said base member;

(c) said release tab is mounted on said arm member.

6. The buckle assembly according to claim 5, wherein the engaging relationship between said clasps and said main buckle results in said release tabs seating in respective locking slots to provide a latching relationship therebetween and each of said clasps is unlatched by depressing the respective release tab inwardly of the corresponding locking slot a sufficient distance to pass beyond said sidewall.

7. The buckle assembly according to claim 6, wherein each of said release tabs includes an exterior surface that extends into the locking slot when the clasp is fully inserted in said main buckle;

said exterior surface is configured and dimensioned so that at least a portion of said exterior surface faces away from the corresponding opening whereby pressure on the portion while depressing the release tab propels the clasp outwardly of the opening.

8. The buckle assembly according to claim 7, wherein said exterior surface is rounded and a finger slides along the rounded surface as the release tab is depressed and the clasp moves away from the locking slot.

9. The buckle assembly according to claim 4, wherein each of said clasps comprises:

(a) a base member and first and second arm members extending from said base member in a lateral spaced apart relation to each other;

(b) said release tab is mounted on said first arm member.

10. The buckle assembly according to claim 9, wherein each of said clasps further includes:

an axially extending guide element extending from said base member and disposed between said first and second arm members.

11. The buckle assembly according to claim 10, wherein said main buckle further includes:

guide means extending axially within each of the openings and complementary to said guide element and spaced inwardly from the locking slot for cooperative sliding engagement with the guide element during telescopic association therebetween without interference with the first and second arm members and the release tab of the clasp.

12. The buckle assembly according to claim 11, wherein said guide element and said guide means are disposed off-center of said base member and the opening, respectively, so that said base member is inserted into the opening only in a particular orientation.

13. The buckle assembly according to claim 4, wherein each of said clasps comprises:

a base member and a first arm member extending from said base member in an axial direction and carrying said release tab; and a second arm member extending from said base member in said axial direction and laterally spaced from said first arm member for engaging said section, whereby the counter pressure exerted by said section on said second arm member provides a more even axial force on said clasp during release thereof.

14. A buckle assembly configured for one-handed release by an operator thereof, the buckle assembly comprising:

a main buckle including a hollow body with two sidewalls, an opening corresponding to each sidewall, and a locking slot extending through each sidewall, wherein the two openings are in communication with each other;

a pair of clasps, each of said clasps including:

(a) a base member;

(b) a first and second arm member extending from said base member, said first arm member is an axially-extending resilient guide element, said two guide elements are disposed parallel to each other when both are fully inserted in said main buckle;

(c1) a release tab mounted on said second arm member, wherein each of said release tabs includes an exterior surface that extends into the locking slot when the clasp is fully inserted in said main buckle;

(c2) said exterior surface is configured and dimensioned so that at least a portion of said exterior surface faces away from the corresponding opening whereby pressure on the portion while depressing the release tab propels the clasp outwardly of the opening;

(c3) said exterior surface is rounded and a finger slides along the rounded surface as the release tab is depressed and the clasp moves away from the locking slot;

guide means extending axially within each of the main buckle openings and complementary to said guide element and spaced inwardly from the locking slot for cooperative sliding engagement with the guide element during telescopic association therebetween without interference with the first arm member and the release tab of the clasps;

said guide element and said guide means are disposed off-center of said base member and the opening, respectively, so that said base member is inserted into the opening only in a particular orientation;

wherein the engaging relationship between said clasps and said main buckle results in said release tabs seating in respective locking slots to provide a latching relationship therebetween and each of said claps is unlatched by depressing the respective release tab inwardly of the corresponding locking slot a sufficient distance to pass beyond said sidewall;

each release tab snaps into the respective locking slot to engage the sidewall upon full insertion of the clasp, and wherein the locking slots are positioned on the main buckle so that the release tabs are adapted for pressure contact by two fingers of one hand to release said pair of clasps, wherein said clasps are adapted for contacting each other upon joint release of said clasps.

15. The buckle assembly according to claim 14, wherein each of said guide elements has a T-shaped cross-section including a base portion, wherein the T-shapes are oriented in opposite directions from each other with the base portions facing each other.

16. The buckle assembly according to claim 15, wherein simultaneous depression of the release tabs biases the base portions of the resilient guide elements into contact with each other so that the clasps are propelled outwardly of the communicating openings together with increased spring-release action.

17. A buckle assembly configured for one-handed release by an operator thereof, the buckle assembly comprising:

a main buckle including a hollow body with two sidewalls, an opening corresponding to each sidewall, and a locking slot extending through each sidewall;

a pair of clasps, each of said clasps including:

(a) a base member;

(b) first and second arm members extending from said base member in a lateral spaced apart relation to each other;

(c1) a release tab mounted on said first arm member, wherein each of said release tabs includes an exterior surface that extends into the locking slot when the clasp is fully inserted in said main buckle;

(c2) said exterior surface is configured and dimensioned so that at least a portion of said exterior surface faces away from the corresponding opening whereby pressure on the portion while depressing the release tab propels the clasp outwardly of the opening;

(c3) said exterior surface is rounded and a finger slides along the rounded surface as the release tab is depressed and the clasp moves away from the locking slot;

(d) an axially extending guide element extending from said base member and disposed between said first and second arm members; and guide means extending axially within each of the openings and complementary to said guide element and spaced inwardly from the locking slot for cooperative sliding engagement with the guide element during telescopic association therebetween without interference with the first and second arm members and the release tab of the clasp;

wherein said guide element and said guide means are disposed off-center of said base member and the opening, respectively, so that said clasp is inserted into the opening only in a particular orientation;

wherein the engaging relationship between said clasps and said main buckle results in said release tabs seating in respective locking slots to provide a latching relationship therebetween, and each of said clasps is unlatched by depressing the respective release tab inwardly of the corresponding locking slot a sufficient distance to pass beyond said sidewall;

wherein each release tab snaps into the respective locking slot to engage the sidewall upon full insertion of the clasp, and wherein the locking slots are positioned on the main buckle so that the release tabs are adapted for pressure contact by two fingers of one hand to release said pair of clasps.

* * * * *